US006581556B2

(12) United States Patent
Kim

(10) Patent No.: US 6,581,556 B2
(45) Date of Patent: Jun. 24, 2003

(54) DEVICE FOR ELECTROMECHANICALLY ACTUATING INTAKE AND EXHAUST VALVE

(75) Inventor: Hyung-Joon Kim, Kunpo (KR)

(73) Assignee: Hyundai Motor Company, Seoul (KR)

( * ) Notice: Subject to any disclaimer, the term of this patent is extended or adjusted under 35 U.S.C. 154(b) by 0 days.

(21) Appl. No.: 10/147,678

(22) Filed: May 16, 2002

(65) Prior Publication Data

US 2003/0037738 A1 Feb. 27, 2003

(30) Foreign Application Priority Data

Aug. 21, 2001 (KR) ..... 2001-0050285

(51) Int. Cl.[7] ..... F01L 9/04

(52) U.S. Cl. ..... 123/90.11; 251/129.01; 251/129.02; 251/129.16

(58) Field of Search ..... 123/90.11, 90.16, 123/90.27; 251/129.01, 129.02, 129.16

(56) References Cited

U.S. PATENT DOCUMENTS 5,269,269 A * 12/1993 Kreuter ..... 123/90.11
6,089,197 A * 7/2000 Lange et al. ..... 123/90.11
6,262,498 B1 * 7/2001 Leiber ..... 123/90.11
6,289,858 B1 * 9/2001 Altdorf et al. ..... 123/90.11

OTHER PUBLICATIONS

Speckens, *FEV–Spectrum*: Technology –Highlights and R&D Activities at FEV; Issue Aug. 12, 1999; pp. 1–6.
A. Wittstamm, *FEV–Spectrum*: Technology –Highlights and R&D Activities at FEV; Issue Apr. 20, 2002; pp. 2–8.
W. Salber, et al.; *The Electro–Mechanical Valve Train –A System Module for Future Powertrain Concepts*; MTZ Motortechnische Zeitschrift 62 (2001) 2; pp. 1–30.

* cited by examiner

*Primary Examiner*—Thomas Denion
*Assistant Examiner*—Ching Chang
(74) *Attorney, Agent, or Firm*—Pennie & Edmonds LLP

(57) ABSTRACT

An electromechanical valve train is provided that includes a housing; an outer coil assembly including a first core having an first aperture formed therein and a first coil wound on the first core; an inner coil assembly including a second core having an second aperture formed therein and a second coil wound on the second core, the inner coil assembly being secured to the first aperture of the outer coil assembly; an armature including an upper plate, a lower plate, a rod connecting the upper plate and the lower plate, and an insulator disposed between the rod and the upper plate or between the rod and the lower plate, the rod being vertically movably inserted into the second aperture of the inner coil assembly; an upper biasing member; a lower biasing member; and a valve connected to the lower plate of the armature.

11 Claims, 5 Drawing Sheets

DEVICE FOR ELECTROMECHANICALLY ACTUATING INTAKE AND EXHAUST VALVE

FIELD OF THE INVENTION

The present invention relates to a valve train for vehicles, and more particularly, to a device for actuating a valve using an electromagnetic force.

BACKGROUND OF THE INVENTION

Generally, in an internal combustion engine, an air-fuel mixture is taken into a combustion chamber through an intake manifold, and the air-fuel mixture is burned in the combustion chamber. After burning, exhaust gas is exhausted into the atmosphere through an exhaust manifold. An intake and an exhaust valve are provided in an intake port and an exhaust port.

A system that includes the intake valve, the exhaust valve, and a device for actuating the intake valve and the exhaust valve is called a valve train. Combustion characteristics of the internal combustion engine depend on operation of the valve train, and therefore, in order to optimally control the burning process, it is important to control the operation of the valve train.

In a particular cam-type valve train, the up and down movement of the intake and exhaust valves is mechanically performed by a rocker arm that is actuated by a camshaft. Because arbitrary control of the up and down movement of each valve is not possible in a cam-type valve train, the cam-type valve train is not suitable for recent electronically controlled engine systems.

An electromechanical valve train is a system in which the open/close timing and open/close duration of the valve can be regulated by an electronic signal. Because the intake valve can regulate an amount of intake air, a throttle valve can be eliminated and pumping loss can be decreased. Further, burning can be performed in an optimal state so that exhaust gas can be decreased, and the structure of the valve train becomes simple.

FIG. 1 shows an example of the electromechanical valve train comprising a valve body 1, a first coil assembly 2 and a second coil assembly 3 that are disposed inside the valve body 1. A plate-shaped armature 4 is disposed between the first and second coil assemblies 2 and 3, and a valve 5 is connected to the armature 4. An upper spring 6 biases the armature in a downward direction, and a lower spring 7 biases the armature in an upward direction.

The valve train is arranged in such a manner that if a current is supplied to the first coil assembly 2, the armature 4 moves downward, and if a current is supplied to the second coil assembly 3, the armature 4 moves upward. Therefore, if a current is supplied to the first coil assembly 2, the valve 5 becomes open, and if a current is supplied to the second coil assembly 3, the valve 5 becomes closed. If a current is supplied to neither the first or second coil assemblies, the armature 4 is located in a equilibrium position.

However, in the electromechanical valve train, an armature plate that is made of iron is magnetized after long use. Thus, although a current is supplied to neither the first coil assembly nor the second coil assembly, an attractive force acts between the coil assemblies and the armature. If the armature is made of a permanent magnet to solve this problem, magnetism of the armature fades because of a high temperature of the combustion chamber, and the weight of the system is also increased.

SUMMARY OF THE INVENTION

In a preferred embodiment of the present invention, an electromechanical valve train comprises a housing defining a chamber, and an outer coil assembly including a first core having an first aperture formed therein and a first coil wound on the first core. The outer coil assembly is fixedly disposed in the chamber. Also included is an inner coil assembly including a second core having an second aperture formed therein and a second coil wound on the second core. The inner coil assembly is secured to the first aperture of the outer coil assembly. An armature is provided including an upper plate, a lower plate, a rod connecting the upper plate and the lower plate, and an insulator disposed between the rod and the upper plate or between the rod and the lower plate. The rod is vertically movably inserted into the second aperture of the inner coil assembly. An upper biasing member downwardly biases the armature and a lower biasing member upwardly biases the armature. In addition, a valve is connected to the lower plate of the armature.

Preferably, the first core of the outer coil assembly is made of a magnetizable material, and the second core of the inner coil assembly is made of an unmagnetizable material.

Further, it is preferable that the electromechanical valve train comprise a position adjuster for regulating a vertical position of the armature by pressurizing the upper biasing member.

BRIEF DESCRIPTION OF THE DRAWINGS

The accompanying drawings, which are incorporated in and constitute a part of the specification, illustrate an embodiment of the invention, and, together with the description, serve to explain the principles of the invention, where.

DETAILED DESCRIPTION OF THE PREFERRED EMBODIMENTS

Hereinafter, a preferred embodiment of the present invention will be described in detail with reference to the accompanying drawings.

Figure 1:
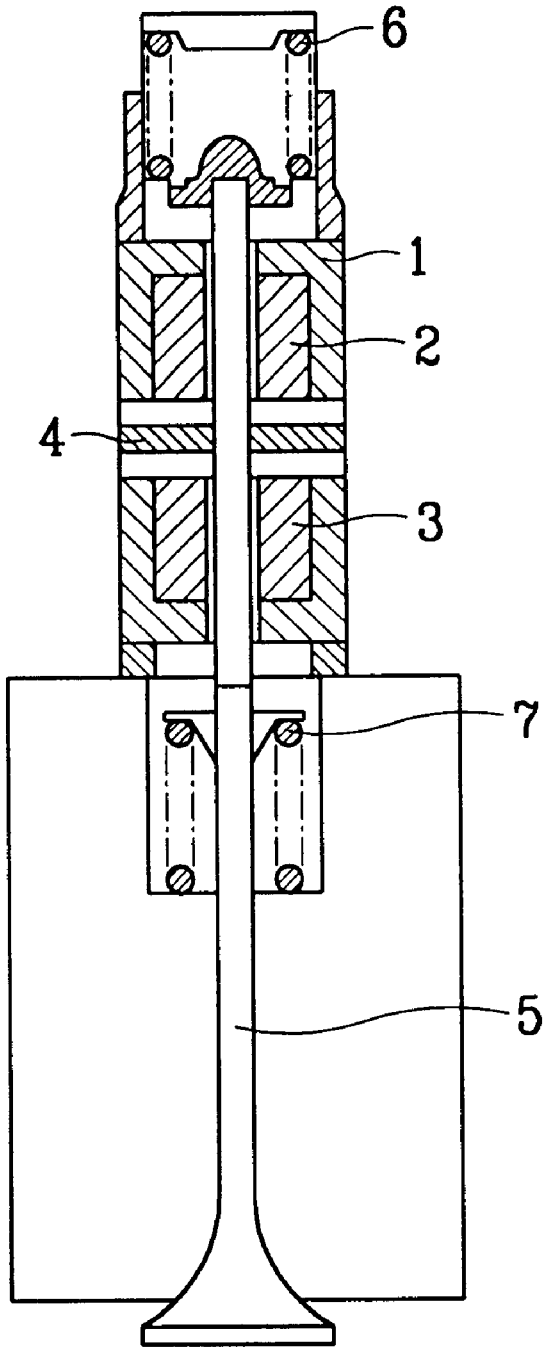
FIG.1(Prior Art)
FIG. 1 is a sectional view of an electromechanical valve train according to the prior art.
Figure 2:
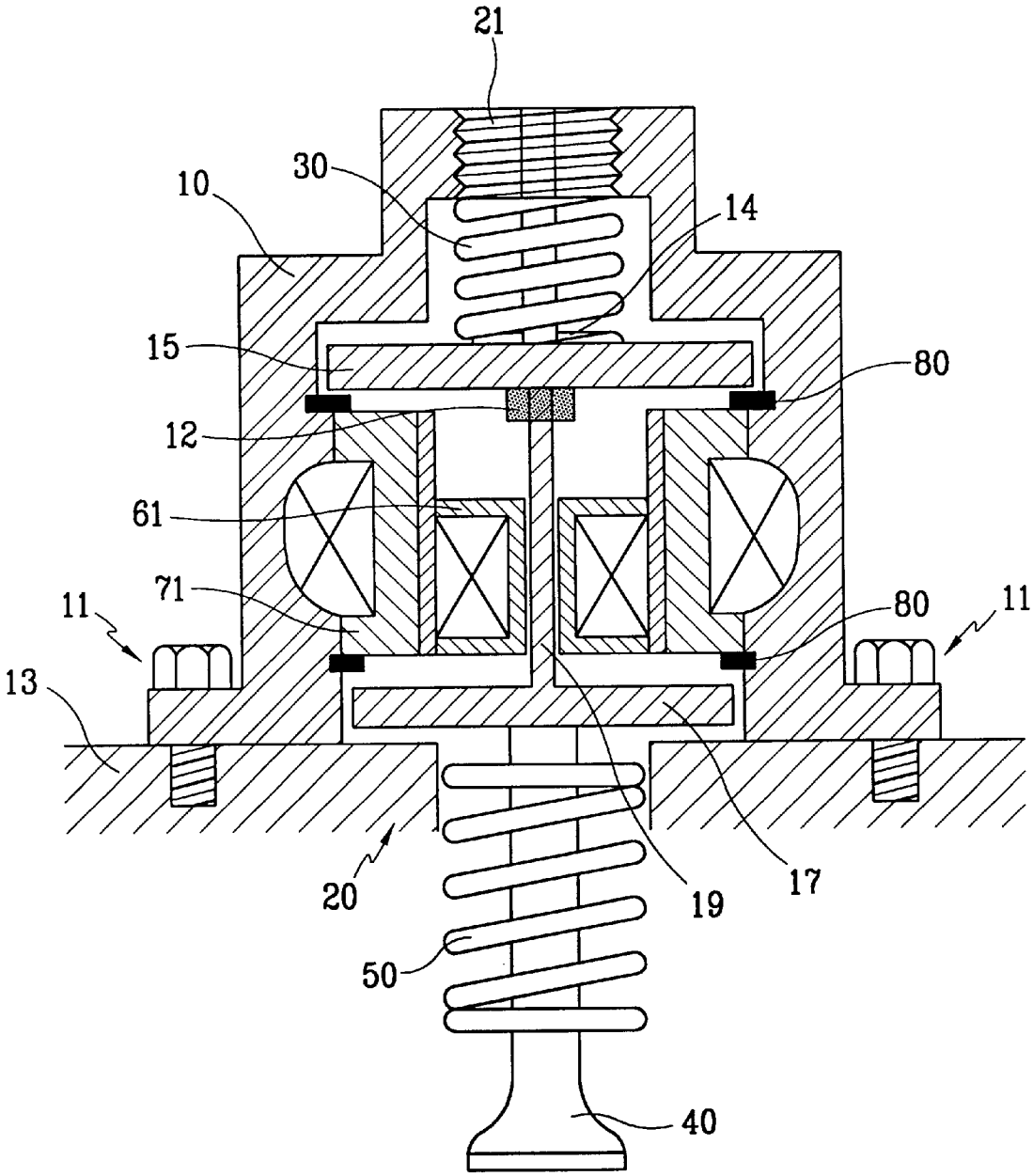
FIG. 2 is a sectional view of an electromechanical valve train according to the preferred embodiment of the present invention.
Figure 3:
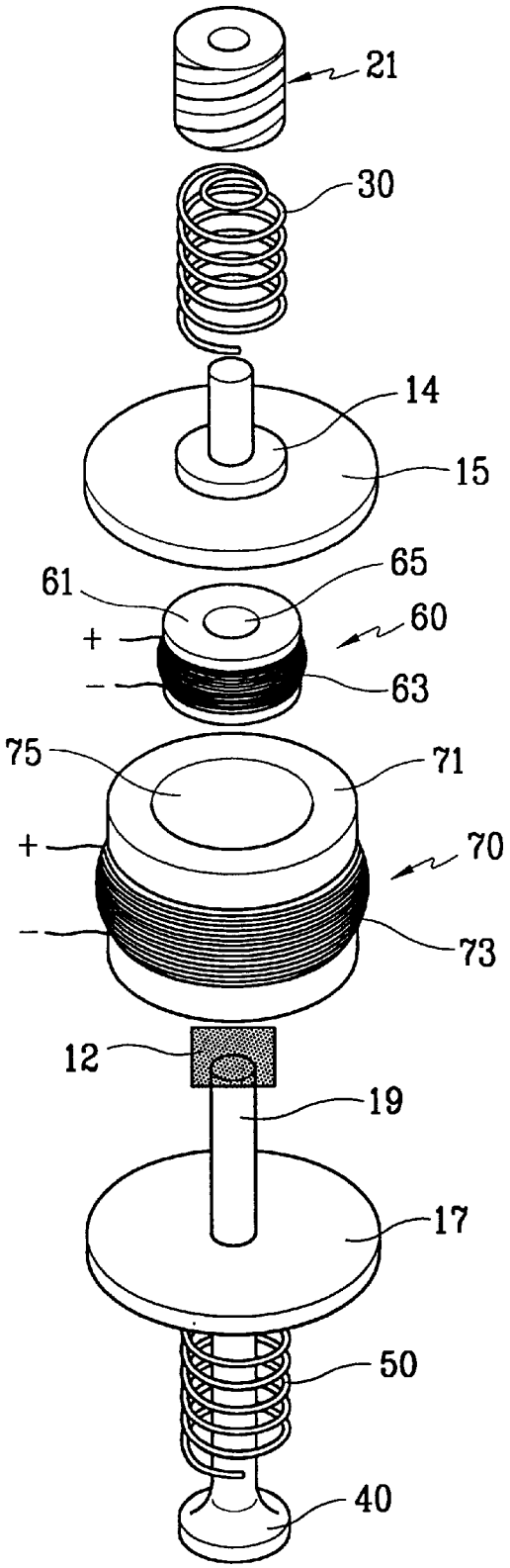
FIG. 3 is an exploded perspective view of the valve train of FIG. 2.

As shown in FIGS. 2 and 3, an electromechanical valve train according to the present invention comprises a housing 10 defining a chamber, an outer coil assembly 70, an inner coil assembly 60, an armature 20, a valve 40 coupled to the armature 20, an upper spring 30, and a lower spring 50.

Housing 10 is provided with a plurality of coupling members 11 through which the housing member 10 is coupled to a cylinder head 13. The housing 10 includes a chamber wherein the outer coil assembly and the inner coil assembly 70 and 60 are disposed. The outer coil assembly 70 is fixedly mounted to an inner wall of the housing 10 by a stopper 80.

The outer coil assembly 70 includes a core 71 and a coil 73 wound on the core 71, the core 71 having an aperture 75, the coil 73 being connected to a current source (not shown in the drawings). The core 71 is made of a magnetizable material, such as iron, such that the core is magnetized if a current is supplied to the coil 73.

The inner coil assembly 60 also comprises a core 61 and a coil 63 wound on the core 61. The core 61 includes an aperture 65, and it is made of an unmagnetizable material, such as plastic. If a current is supplied to the coil 63 that is wound on the plastic core 61, a magnetic field is formed in the aperture 65. As shown in FIG. 2, the inner coil assembly 60 is inserted into the aperture 75 of the outer coil assembly 70 that is fixedly mounted to the housing 10 and fixedly secured to the core 71 of the outer coil assembly 70.

The armature 20 comprises an upper plate 15, a lower plate 17 and a rod connecting the upper plate 15 and the lower plate 17. The armature 20 is made of a magnetizable material such as iron. A plastic cap 12 is disposed between the rod 19 and the upper plate 15 so that the upper plate 15 and the lower plate 17 are not magnetized together. That is, the upper plate 15 and the lower plate 17 are insulated from each other by the plastic cap 12. It is evident that the plastic cap 12 can be alternatively disposed between the rod 19 and the lower plate 17.

To prevent the armature 20 from colliding with the plastic cap 12, the inner coil assembly 60 is preferably coupled to the outer coil assembly 70 in such a manner that an upper surface of the core 61 of the inner coil assembly 60 is lower than that of the core 71 of the outer coil assembly 70. The rod 19 of the armature 20, as shown in FIG. 2, is movably inserted into the aperture 65 of the inner coil assembly 60.

A screw 21 is coupled to an upper portion of the housing 10, and an upper valve spring 30 is disposed between the screw 21 and the upper plate 15 of the armature 20. A cylindrical projection 14 is formed in the upper plate, the upper valve spring being inserted therein such that the upper valve spring does not move laterally. A lower valve spring 50 is disposed between the lower plate 17 of the armature 20 and the cylinder head 13. The armature 20 is biased by the upper valve spring 30 and the lower spring 50. If a current is supplied to neither the outer coil assembly 70 or the inner coil assembly 60, the armature 20 maintains its specific vertical center position. By rotating the screw 21, the specific vertical center position can be changed.

Operation of an electromechanical valve train according to an embodiment of the present invention is explained in detail hereinafter.

Figure 4:
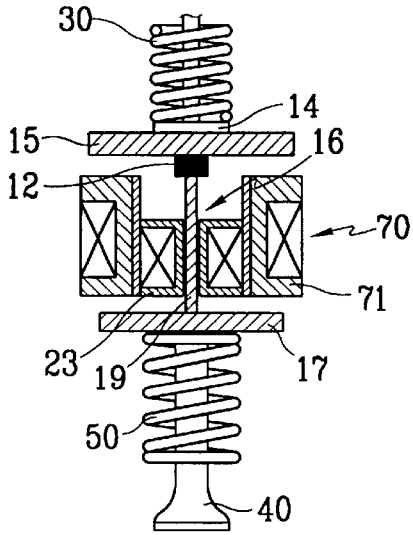
FIGS. 4, 5, and 6 respectively show a neutral state, a closed state, and an open state of the valve train of FIG. 2.

As shown in FIG. 4, when a current is not supplied to the coil assemblies 60 and 70, the armature 20 is located in the vertical center position in an equilibrium of the biasing forces of the upper valve spring 30 and the lower valve spring 50.

Figure 5:
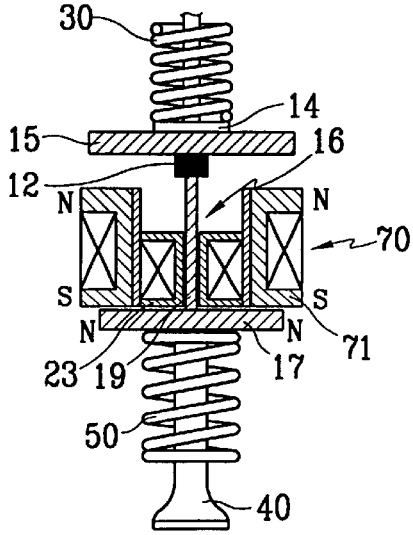

FIG. 5 shows a state in which the valve is closed.

If current is supplied to the coil 73 of the outer coil assembly 70 such that the core 71 is magnetized, an upper portion of the core 71 becomes a north (N) pole, and a lower portion of the core 71 becomes a south (S) pole.

If a current is supplied to the coil 63 of the inner coil assembly 60, a magnetic field is formed in the aperture 65 of the inner coil assembly 60. Therefore, the rod 19 and the lower plate 17 are magnetized because of the magnetic field. The direction of the current supplied to the coil 63 is determined such that an upper portion of the rod 19 becomes a S pole and the lower plate 17 becomes an N pole. The upper plate 15 is not magnetized because of the plastic insulator cap 12.

Because the bottom of the core 71 of the outer coil assembly 70 and the lower plate 17 of the armature 20 are of opposite poles, the core 71 pulls the lower plate 17 so that the valve 40 moves upward and the valve 40 is then closed. The upper valve spring 30 is compressed and the lower valve spring 50 is extended.

If it were not for the plastic cap 12, the upper plate 15 would be magnetized as the S pole and the lower plate 17 would be magnetized as the N pole. Therefore, the core 71 of the outer coil assembly 70 would pull the upper plate 15 downward and the lower plate 17 upward. In the current situation, the armature 20 cannot move upward.

Figure 6:
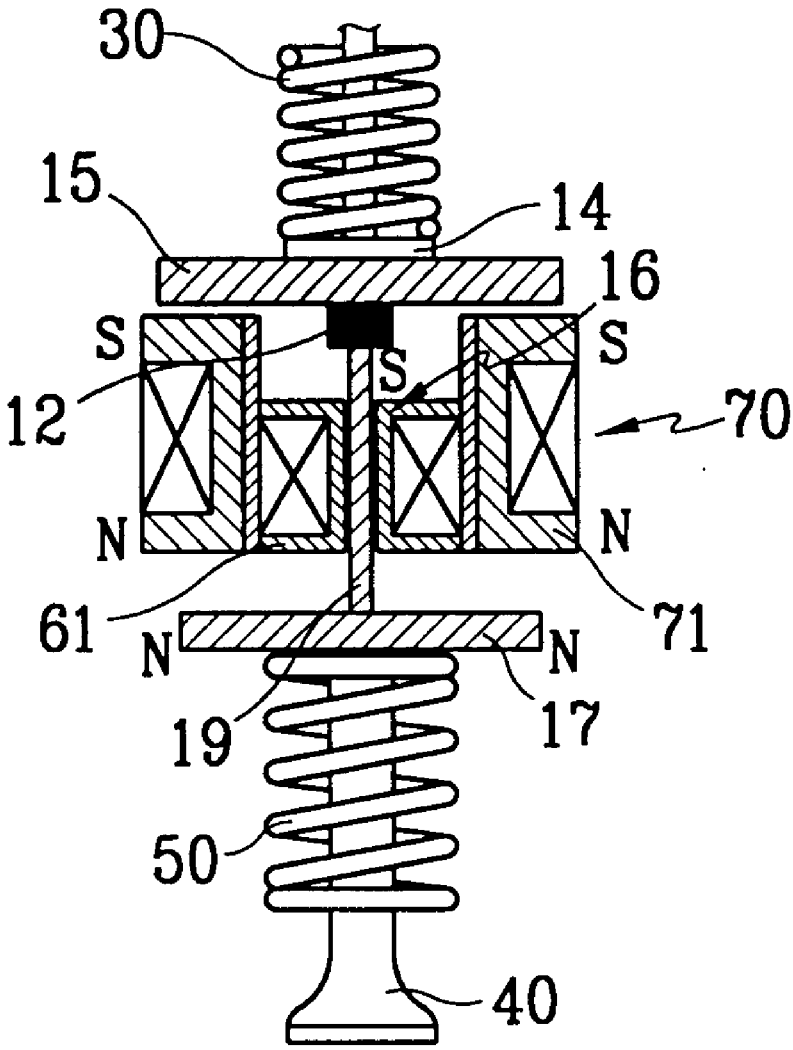

FIG. 6 shows the state in which the valve is open.

If a current is supplied to the coil 63 of the inner coil assembly 60 in the same direction as in FIG. 5 and a direction of a current supplied to the coil 73 of the outer coil assembly 70 is made to be opposite to that of FIG. 5, the lower portion of the core 71 of the outer coil assembly 70 is magnetized to a N pole and the upper portion of the core 71 is magnetized to a S pole.

The lower portion of the core 71 and the lower plate 17 of the armature 20 are then the same poles, and therefore the core 71 repels the lower plate 17 of the armature 20 so that the armature 20 moves downward. Consequently, the valve 40 is opened. The upper valve spring 30 is then extended and the lower valve spring 50 is compressed.

In the electromechanical valve train according to a preferred embodiment of the present invention, the vertical position of the armature is controlled by the direction of the current supplied to the outer coil assembly so that a response characteristic of the valve improves.

Also, if the magnetic field can be controlled by the structure of the coil assembly and an amount of the current supplied to the coil assembly, the size of the armature can be reduced. Therefore, a total weight of the valve train can be reduced.

Furthermore, because the lower plate of the armature is made of iron, the response speed of the armature can be improved and the phenomenon that the armature unnecessarily adheres to the coil assembly is reduced.

Although preferred embodiment of the present invention have been described in detail hereinabove, it should be clearly understood that many variations and/or modifications of the basic inventive concepts herein taught which may appear to those skilled in the present art will still fall within the sprit and scope of the present invention, as defined in the appended claims.

What is claimed is:

1. An electromechanical valve train comprising:

a housing defining a chamber;

a first and a second coil assembly disposed in said chamber of said housing;

an armature disposed between said first and second coil assemblies, said armature including an upper plate, a lower plate, a rod connecting said upper plate and said lower plate, and an insulator disposed between said rod and said upper plate or between said rod and said lower plate;

a valve coupled to a lower part of said armature;

a first valve spring downwardly biasing said armature; and a second valve spring upwardly biasing said armature.

2. The electromechanical valve train of claim 1, wherein said insulator is a plastic cap.

3. The electromechanical valve train of claim 1, further comprising an adjuster for regulating a vertical position of said armature.

4. The electromechanical valve train of claim 1, wherein said armature further comprises a cylindrical projection formed in said upper plate, said projection protruding into said first valve spring such that said first valve spring does not move laterally.

5. An electromechanical valve train comprising:

a housing defining a chamber;

an outer coil assembly including a first core having an first aperture formed therein and a first coil wound on said first core, said outer coil assembly being fixedly disposed in said chamber;

an inner coil assembly including a second core having an second aperture formed therein and a second coil wound on said second core, said inner coil assembly being secured to said first aperture of said outer coil assembly;

an armature including an upper plate, a lower plate, a rod connecting said upper plate and said lower plate, and an insulator disposed between said rod and said upper plate or between said rod and said lower plate, said rod being vertically movably inserted into said second aperture of said inner coil assembly;

an upper biasing member downwardly biasing said armature;

a lower biasing member upwardly biasing said armature; and a valve connected to said lower plate of said armature.

6. The electromechanical valve train of claim 5, wherein said first core of said outer coil assembly is made of a magnetizable material.

7. The electromechanical valve train of claim 5, wherein said second core of said inner coil assembly is made of an unmagnetizable material.

8. The electromechanical valve train of claim 5, wherein said insulator of said armature is a plastic cap.

9. The electromechanical valve train of claim 5, further comprising a position adjuster for regulating a vertical position of said armature by pressurizing said upper biasing member.

10. The electromechanical valve train of claim 5, wherein said armature further comprises a cylindrical projection formed on said upper plate, said projection protruding into said upper biasing member such that said biasing member does not move laterally.

11. The electromechanical valve train of claim 5, wherein said outer coil assembly is coupled to said housing by a stopper.

* * * * *